United States Patent [19]

Acres

[11] 4,154,366

[45] May 15, 1979

[54] DISPENSING CONTAINER

[76] Inventor: Alexander D. Acres, 368 Glenrose Dr., London, Ontario, Canada, N6K 2A8

[21] Appl. No.: 764,013

[22] Filed: Jan. 31, 1977

[51] Int. Cl.[2] ..... B65D 35/28

[52] U.S. Cl. ..... 222/95

[58] Field of Search ..... 222/95, 212, 213, 94, 222/494, 490, 386.5

[56] References Cited

U.S. PATENT DOCUMENTS

| | | | |
|---|---|---|---|
| 2,679,336 | 5/1954 | Frick | 222/212 X |
| 3,223,289 | 12/1965 | Bouet | 222/95 X |
| 3,319,837 | 5/1967 | Mueller | 222/386.5 X |
| 3,937,371 | 2/1976 | Del Bon | 222/494 |

*Primary Examiner*—Joseph F. Peters, Jr.

*Assistant Examiner*—Norman L. Stack, Jr.

*Attorney, Agent, or Firm*—Finnegan, Henderson, Farabow & Garrett

[57] ABSTRACT

Resiliently squeezable container is disclosed which is partitioned into two chambers, an ingredient chamber, which communicates through a discharge orifice to the outside, and an air chamber which communicates through a reclosable valve to the ambient atmosphere. The reclosable valve is such that the pressure within each chamber is held in equilibrium. Thus, on squeezing of the container ingredients are exuded from the ingredient container and on release of the container air enters through the reclosable valve into the air chamber to re-establish equilibrium within the container. Thus, on a separate cyling or squeezing, the ingredient is instantaneously available for discharge.

1 Claim, 9 Drawing Figures

DISPENSING CONTAINER

This invention relates to containers for pastes, creams, ointments and the like of the type which may be collapsed to force or exude paste or cream from the container.

The invention has as its object the provisions of a sanitary, easily used, hence and easily stored squeezable container. No outer covering container such as protective cardboard box is required to merchandise the product contained in the container. The container contemplates a cylindrical or non cylindrical (such as oval shaped cross section) form.

This object is achieved by using a pliable outer housing and a resilient inner membrane mounted peripherally at its lower extremity to the base or bottom of the container. It is at this lower peripheral edge that the base or bottom and the outer pliable housing together with the inner resilient membrane are joined. Thus we have a container having two cavities, one cavity communicating through a valve, to the ambient atmosphere so that the ambient atmosphere may be vented into the (first) air cavity as when the container is squeezed and the second cavity which contains an ingredient which is to be squeezably removed from the container. By squeezing the container the volume decreases in the air cavity (pressure increases) and causes pressure to act on the ingredient cavity. It collapses causing the ingredients therein to be exude from the orifice.

The invention therefore contemplates an ingredient dispensing container comprising:

(a) a resilient housing defining a self reclosing valve and an ingredient discharging orifice;

(b) a movable membrane mounted in the housing partioning the housing into two chambers, a first chamber communicating with the self reclosing valve and a second chamber containing ingredients which communicate with the ingredient discharging orifice;

(c) the self reclosing valve, adapted to open and to convey ambient fluid into the first chamber, when the pressure in said first chamber is less than ambient, so as to maintain both chambers at essentially equal pressure so that when the container is squeezed, ingredients are urged from the second chamber and expelled through the discharge orifice.

Preferably the membrane is resilient.

The invention will now be described by way of example and reference to the accompanying drawings in which.

Figures 1, 2, 3, 4, 5, 6, 7, 8, 9:
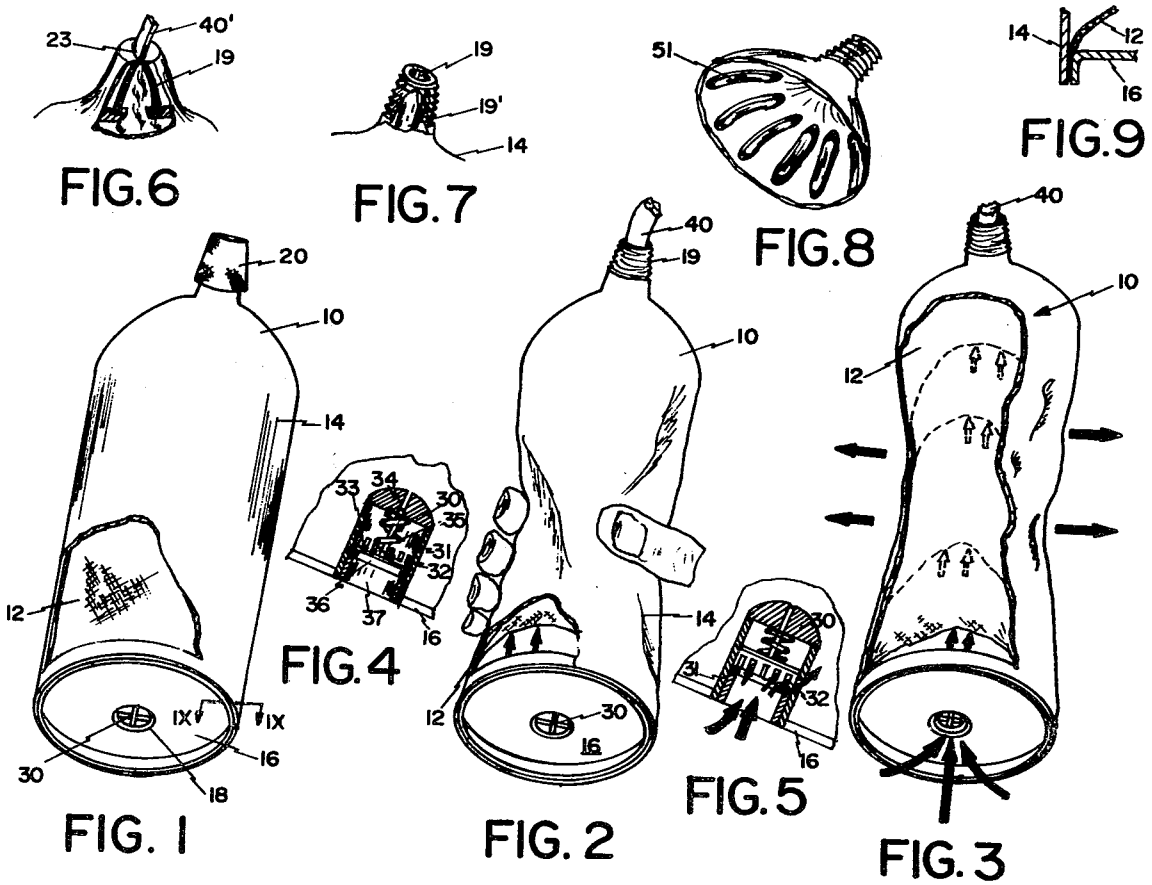
FIG. 1 is a perspective, partially in section, of an embodiment.
FIG. 2 is the embodiment of FIG. 1 during discharge cycle of the ingredient.
FIG. 3 is the embodiment of FIG. 1, partially broken away, during the recovery cycle of the container.
FIG. 4 illustrates the self reclosing valve, during all conditions save recovery.
FIG. 5 is a sectional view of the self reclosing valve of FIG. 4 during recovery.
FIG. 6 is a sectional view of a discharging orifice with automatic closing means.
FIG. 7 is a perspective, partially in section, of an alternative discharging orifice.
FIG. 8 is a perspective of the upper portion of the container, showing a ribbing mechanism which enhances ingredient discharge.
FIG. 9 is a sectional view along lines IX—IX of FIG. 1.

Referring to FIG. 1, the container 10 includes a resilient housing of conventional plastic material formed into essentially the shape of a bottle 14. It has a flat plate 16 as its bottom. The bottom 16 defines an orifice 18 into which is mounted or affixed a self reclosing valve 30. The bottle is preferable molded of two portions, the container portion itself and the bottom which is subsequently press fitted into the container portion. In the interior of the container 10 is mounted a resilient membrane 12 which is affixed or attached the interjoining margins of the bottom with the container portion in a snap like fashion. This membrane 12 defines the interior of the container into two chambers, one which communicates with the valve 30 and hence with the ambient environment of the container and the other with the discharge orifice 19.

The valve 30 consists of a housing 31 together with peripheral communicating aperatures 32. A piston 33 has its stem 34 extending out of the housing. A coil spring 35 mounted between the housing 31 and piston surrounds the stem 34 and urges the piston 33 into sealing arrangement with a O-ring 36. The O-ring is affixed to the terminus of a channel 37 which communicates to the outside of the container and hence the ambient region.

The discharge orifice 19 may be of two forms. It may be a conventional orifice shown in FIG. 7 having a discharging channel 19' and a circumscribing thread onto which a screw cap 20 may be affixed to close the container. Alternatively, refering to FIG. 6, the discharge orifice 19 may be composed of resilient double lips 23 which normally urge close the orifice. When ingredient pressure is sufficiently great, the two lips separate and allow the emination of ingredients from the container as at 40'.

In operation, the container is filled with an ingredient 40. This may be accomplished in two ways. Firstly, the ingredient, whether it be paste, ointment or cream, may be inserted into the container prior to the affixing of the membrane and of the base into the bottom of the container portion. Alternatively, using means not shown, the container may be filled by a pressure nozzle by inserting the same into the channel 19' while a valve 30 is opened with a stud. This requires, that previous to filling, the membrane 12 must be in a so-called erect position, that is, migrated away from the reclosable valve into the total exhaust position, that is into a position where the membrane 12 extends along and is urged against the total inside circumference of the collapsible container to such a degree that the effective volume of the ingredient chamber is nil while the effective volume of the air chamber is maximum. Ingredients are then injected through the orifice and the reclosable valve is mechanically open so as to vent the air chamber. The ingredient chamber thus is filled and correspondingly, the air chamber is vacated.

Assuming that the container is filled with ingredients and hence the ingredient chamber is maximum while the air chamber is minimum, the ingredient may be removed from the container as follows. Since the container portion housing is resilient, in order to get the ingredient 40 out of the container, one may grasp the container with the hands as in FIG. 2 and collapse the bottle. The reclosable valve remains closed but the inside pressure, in the first chamber, which communicates with the reclosable valve, is increased. When the cap 20 is off, the ingredients contained in the second chamber are urged to flow out of the discharging orifice as shown in FIG. 2 by the excess pressure in chamber one. When the container is released, as in FIG. 2, the first chamber tends to enlarge so as to assume a position of equilibrium between the ingredients in the second chamber and the internal atmosphere of the first chamber. This is achieved by having the closable valve open under the pressure of the vacuum in the first chamber as at FIG. 5. Thus ambient atmosphere flows as illustrated by the arrows in FIG. 5 into the first chamber. By repeating the process of alternatively releasing and squeezing the container, the ingredients are discharged from the container.

Now as the container is voided of ingredients, see FIG. 3, the membrane 12 migrates to various positions, increasing the size of the air chamber, (first chamber) and decreasing the size of the ingredient chamber. This relative progression urges the ingredients 40 from the container.

In applications where the ingredients of the container are not highly susceptible to drying out, as for example, grease and other such materials, the relative friction between the ingredients against the internal walls of the discharge orifice 19 (which in that region really is essentially the form of a discharge channel 19') will cause sufficient immobility that the self reclosing valve will open during recovery so as to permit outside ambient fluid such as air to enter into the air chamber and hence re-establish equilibrium between the two chambers. Thus, at all times during each cycle, recovery or squeeze, and even when the container is idle, constant pressure is placed on the ingredient chamber by the air chamber via the separating membrane. The separating membrane preferably therefore is a resilient polymer or other resilient material. This mechanism has the advantage of course, that in subsequent cyclings for ingredient discharge, instant ingredient discharge is achieved, simply, by slightly squeezing the container since the ingredient ingredients are effectively placed in the "ready" position by the previous discharge and recovery cycle and the relative equilibrium between both chambers.

Where it is desired not to use a screwable cap 20 as the closure, a resilient lip closure such as that shown in FIG. 6 can be used. The resilient lips 23 separate and allow the ingredients to pass by the lips to the outside when the ingredient chamber is subject to significant pressure by the air chamber to overcome the inherent resistance of the mating lips.

During terminal evacuation of the ingredients from the container, it has been found, if ribs 51 are not mounted onto the internal shoulder of the container, that the membrane has a tendancy to migrate more quickly toward the orifice 19 and hence tends to seal it off while leaving some ingredients in the container (within the second chamber). The effect of the ribs 51, tend to slow the progression of the head of the membrane toward the orifice 19; hence insuring that the membrane migrates against the internal walls and ribs of the container continuously so as to force virtually 100% of the ingredients out of the container at exhaustion.

Alternatively, ribs 51 could be impregnated onto the membrane 12 to assist in evacuation but such mechanism is more difficult to manufacture.

The embodiments of the invention in which an exclusive property or privilege as claimed is defined as follows:

1. An ingredient dispensing container having a bottom comprising:

(a) a resilient housing having a self reclosing valve at the bottom and an ingredient discharge orifice at the top thereof, the housing provided with space ribs on its internal surface adjacent to its discharge orifice;

(b) a resilient membrane mounted across the bottom of the housing and partioning the device into a first chamber communicating with a self reclosing valve and a second chamber containing ingredients which communicate with the ingredient discharging orifice;

(c) the self reclosing valve adapted to open and to permit ambient fluid to enter the first chamber when the pressure in the first chamber is less than ambient, said ambient fluid causing said membrane to stretch and to move toward the top of said container to maintain both chambers at essentially equal pressure, so that when a container is squeezed, the ingredients are urged from the second chamber and expelled through the discharge orifice while the ribs prevent the membrane from lying flat against the housing surface.

* * * * *